United States Patent [19]

Someya

[11] Patent Number: 4,551,922

[45] Date of Patent: Nov. 12, 1985

[54] LINE MARKING DEVICE

[76] Inventor: Yoshihiro Someya, 1-27-2, Naka-machi, Musashino-shi, Tokyo, Japan

[21] Appl. No.: 636,955

[22] Filed: Aug. 2, 1984

[30] Foreign Application Priority Data

Aug. 2, 1983 [JP] Japan ..... 58-119853[U]

[51] Int. Cl.[4] ..... B44D 3/38

[52] U.S. Cl. ..... 33/414; 33/339

[58] Field of Search ..... 33/413, 414, 404, 451, 33/1 LE, 342, 339

[56] References Cited

U.S. PATENT DOCUMENTS

| | | | |
|---|---|---|---|
| 2,524,596 | 10/1950 | Kamp | 33/413 |
| 2,636,275 | 4/1953 | Whittington | 33/413 |
| 2,655,728 | 10/1953 | Cook | 33/414 |
| 4,202,108 | 5/1980 | Adams, Jr. et al. | 33/414 |
| 4,228,588 | 10/1980 | Horton, Jr. | 33/413 |

FOREIGN PATENT DOCUMENTS

| | | | |
|---|---|---|---|
| 82296 | 7/1895 | Fed. Rep. of Germany | 33/414 |
| 52-170796 | 12/1977 | Japan . | |

*Primary Examiner*—William D. Martin, Jr.
*Attorney, Agent, or Firm*—Armstrong, Nikaido, Marmelstein & Kubovcik

[57] ABSTRACT

A pipe assembly has arm members pivoted to the opposite ends thereof, guide wheels are rotatably mounted on each of the arm members, a spirit level, reels and a handle are mounted on the pipe assembly, an ink pad assembly is mounted on one of the arm members, a line marking string is anchored to the opposite ends to the reels to be payed out of one of the reels and wound about the other reel under tension whereby the string is struck against an object on which a line is to be marked. Angle members are secured to the opposite ends of the pipe assembly and a weighted string is suspended vertically from one of the angle members for marking a line on an object orientated vertically.

5 Claims, 6 Drawing Figures

LINE MARKING DEVICE

BACKGROUND OF THE INVENTION

Horizontal and vertical measurements are essential operations for construction of indoor and outdoor structures in building and civil engineering works and for installation of machines and the like. For these measurement operations, relatively simple devices such as weighted suspension devices, spirit levels and water-containing rubber tube levels and optical measurement instruments have been usually employed.

However, for simple measurement, when the weighted suspension string is employed, it has been followed that first of all, one worker stands in a predetermined position holding the weighted string or positions an upper portion of the string along a wall on which a line is to be marked and another worker marks a point of perpendicularity on the wall while restraining the weight against swinging and thereafter, they mark a vertical line on the wall between the predetermined position or the fixed upper portion of the string positioned and the point of perpendicularity using an ink pad and a ruler, that is, the conventional vertical measurement requires two separate operation steps. Further, also when a horizontal line is to be marked on a wall, it is necessary that two spaced points are set on the wall in alignment with each other in a horizontal plane and a line is marked connecting between the two points.

Thus, also when horizontal and vertical lines are to be marked on objects having different heights and widths by the conventional methods, workers have to perform line marking operations while repeatedly ascending and descending foot stools and/or ladders resulting in loss of labor and time.

Also when a line is marked on a wall panel employing a carpenter's ink pad assembly including an ink pad, a pointed leader, a length of rolled string extending between and secured at the opposite ends to the pad and leader and a handle for hauling the string in, the leader is anchored to the wall panel at a selected point on the panel, the string is unrolled and tensed and the tensed string is caused to strike against the panel. One example of the carpenter's ink pad assemblies is shown in Japanese Laid-Open Utility Model No. 170796/1977. Although the entire line marking operation can be performed by a single worker, when an object on which a line is to be marked is formed of hard material such as concrete or steel, the line marking employing the ink pad assembly still has the drawback that two workers are required to perform the operation, that is, one worker assigned to manipulate the leader and another worker assigned to manipulate the ink pad.

SUMMARY OF THE INVENTION

Therefore, the present invention is to provide a line marking device which enables a single worker to easily and positively perform horizontal and vertical measurement as well as horizontal and vertical line marking.

A preferred embodiment of the line marking device of the present invention generally comprises an extensible pipe assembly, a pair of arm members pivoted to the opposite ends of the pipe assembly, two reels rotatably supported on the pipe assembly between the opposite ends of the pipe assembly, an ink pad assembly mounted on one of the arm members, guide wheels rotatably supported on the arm members, a line marking string anchored at the opposite ends to the reels and guided along the guide wheels and a spirit level mounted on the pipe assembly between one of the arm members and one of the reels.

In operation for vertical line marking, the pipe assembly is extended to a length corresponding to the distance between the ceiling and floor of a building and erected vertically to cause the arm members to abut against the ceiling and floor, the line marking string is payed out of one of the reels and at the same time wound about the other reel to tense the string extending between the guide wheels and the string is struck against a wall of the building.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
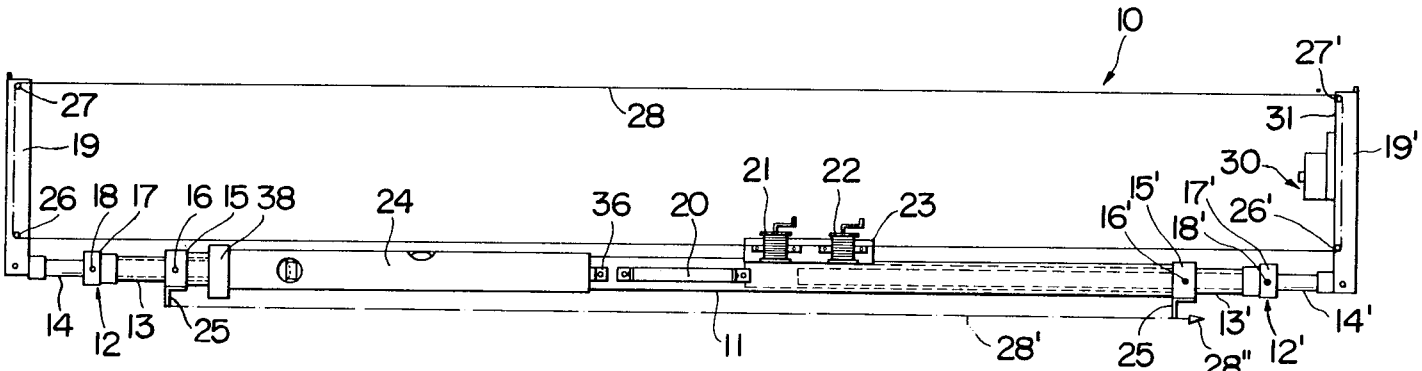
FIG. 1 is a plan view of the preferred embodiment of the line marking device constructed in accordance with the principle of the present invention.
Figure 2:
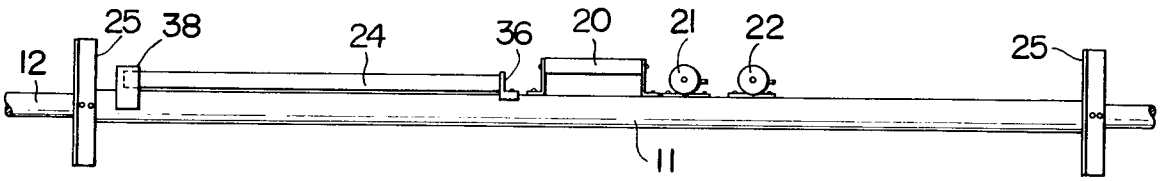
FIG. 2 is a fragmentary side elevational view of said line marking device showing the main pipe of said line marking device.

The present invention will be now described referring to the accompanying drawings in which the preferred embodiment of the line marking device of the invention is shown for illustration purpose. The line marking device is generally shown by reference numeral 10 and generally comprises a pipe assembly which includes a main pipe 11 and a pair of expansion joints 12, 12' telescopically received in the opposite end portions of the main pipe 11. Since the two expansion joints 12, 12' are identical with each other in construction and operation, description will be had on only one of the expansion joints (the left-hand expansion joint 12 as seen in FIG. 1) and the parts associated with the one expansion joint. The expansion joint 12 comprises a first pipe section 13 telescopically received at one or the inner end in the adjacent end portion of the main pipe 11 and a second pipe section 14 telescopically received at one or the inner end in the other or outer end portion of the first pipe section 13. A stop ring 15 is provided on the end portion of the main pipe 11 adjacent to the first pipe section 13 of the associated expansion joint 12 and a set screw 16 is provided on the stop ring to set the pipe section in a desired or selected position relative to the main pipe. Similarly, a stop ring 17 is provided on the outer end portion of the first pipe section 13 and a set screw 18 is provided on the stop ring 17 to set the second pipe section 14 in a sesired or selected position relative to the first pipe section.

A first arm member 19 is pivoted at one end to the outer end of the second pipe section 14 of the expansion joint 12 and similarly, a second arm member 19' is pivoted at one end to the outer end of the second pipe section 14' of the expansion joint 12' telescopically received in the other or right-hand end portion of the main pipe 11.

A handle 20 is provided on the main pipe 11 between the opposite ends thereof for carrying the line marking device about and spaced reels 21, 22 are supported in a pedestal 23 which is in turn mounted on the main pipe 11 adjacent to the right-hand end of the handle 20 as seen in FIG. 1. Also provided on the main pipe 11 adjacent to the left-hand end of the handle 20 (as seen in FIG. 1) is a spirit level 24. Angle members 25, 25 are secured to the stop rings 15, 15' which are employed when the line marking device 10 is operated for vertical measurement in which a weighted string is suspended from one of the angle members as will be described hereinafter.

Guide wheels 26, 27 are rotatably mounted in a position adjacent to the pivot point of the first arm member 19 to the expansion joint 12 and at the other end of the arm member, respectively and similarly, guide wheels 26', 27' are rotatably mounted in a position adjacent to the pivot point of the second arm member 19' to the expansion joint 12' and at the other end of the associated arm member, respectively. A length of line marking string 28 is anchored at the opposite ends thereof to the reels 21, 22, respectively and guided along the path defined by the guide wheels 26, 27 and 26', 27'. Although not shown, the reel 22 is provided with a retaining means adapted to prevent the reel from inadvertently rotating when the line marking device is not used for its intended purpose. An ink pad assembly 30 is mounted on the second arm member 19' between the spaced opposing guide wheels 26', 27'. In the operation of the line marking device, first of all, the line marking device is set up for marking a line on an object on which a line is to be marked disposed horizontally or vertically and the retaining means associated with the reel 22 is released to allow the operator to rotate the reel 21 so as to pay the string out of the reel 22 and at the same time wind the string 28 about the reel 21. The line marking string 28 is soaked with ink as the sting passes through the ink pad assembly 30 and struck against the object under tension to mark a line on the object.

Figure 5A:
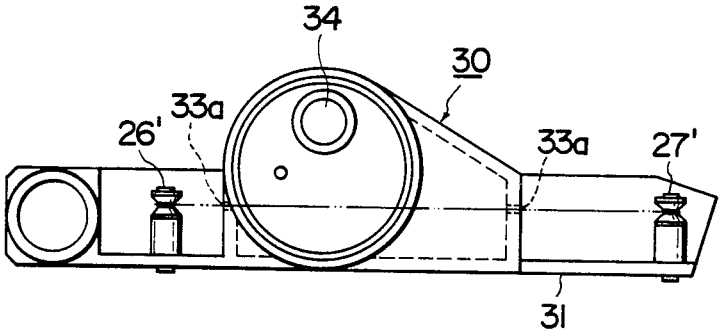
FIG. 5*a* is a fragmentary plan view on an enlarged scale of the ink pad assembly of said line marking device.
Figure 5B:
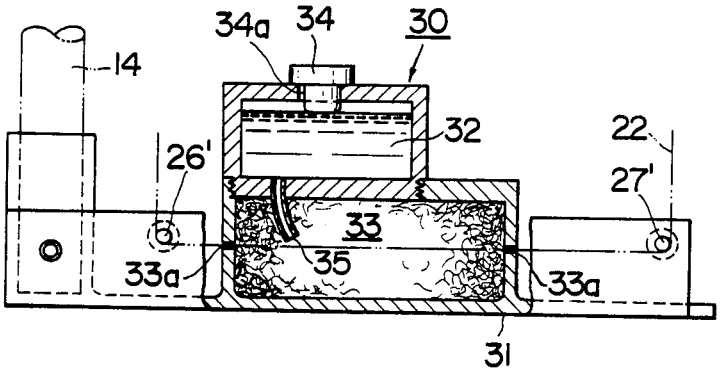
FIG. 5*b* is a fragmentary side elevational view in partial section of said ink pad assembly as shown in FIG. 5*a*.

As more clearly shown in FIGS. 5*a* and 5*b*, different from the conventional manual type, the ink pad assembly 30 of the line marking device according to the present invention generally comprises a bottom support member 31, an ink tank 32 for receiving a supply of ink and an inking chamber 33 integrally formed with the bottom support member 31. The inking chamber 33 has the ink tank 32 threaded therein and contains an ink pad formed of silk or cotton. A threaded plug 34 is threaded into the threaded opening in the top wall of the ink tank 32 and has an orifice 34*a* extending vertically along one side of the threaded shank of the plug 34 so that the flow rate of air entering the ink tank 32 can be regulated by tightening and loosening the plug 34. A communication pipe 35 extends through the bottom wall of the ink tank 32 into the inking chamber 33 and the flow rate of ink to be supplied from the ink tank into the inking chamber can be also regulated when the air flow rate flowing into the ink tank is regulated by the plug 34 as mentioned hereinabove. The inking chamber 33 contains the ink pad formed of silk or cotton as employed in the conventional manual type ink pad assembly and is provided in the two opposing side walls thereof with aligned string holes 33*a*, 33*a*. As the line marking string 28 passes through the inking chamber 33 at the aligned holes 33*a*, 33*a*, the string 28 is supplied ink thereto from the ink pad. The inking chamber 33 is not necessarily integrally formed with the bottom support member 31 by casting aluminum, but may be formed of plastic separately from the bottom support member and then suitably attached to the latter. In the latter case, the inking chamber is preferably positioned in a lower portion of the device so that the device can be easily handled.

As more clearly shown in FIG. 1, the spirit level 24 mounted on the main pipe 11 may be of the conventional one having two spirit pipes for vertical and horizontal line marking, respectively and the level is supported in its lower portion on a lower support member 36 in the form of an angle.

Figure 4:
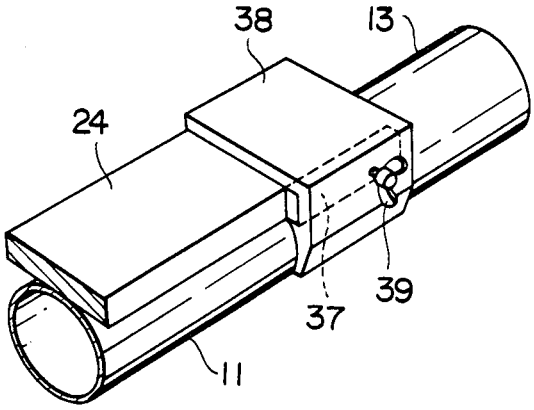
FIG. 4 is a fragmentary horizontally perspective view on an enlarged scale of the spirit level of said line marking device.

As more clearly shown in FIG. 4, a flat bar 37 extends upwardly from the spirit level 24 into an opening defined between the main pipe 11 and an upper support member 38 which partially embraces the spirit level 24. The upper support member 38 is in the form of an angle member and has a threaded hole in the vertical portion thereof for receiving an adjusting screw 39 the leading end of which abuts against the flat bar 37. By turning the adjusting screw 39 to rock the spirit lever 24 on one end portion thereof, the orientation of the spirit level 24 can be adjusted.

The adjusting screw 39 adjusts the orientation of the spirit level 24 so that when the section of the string 28 positioned between the guide wheels 27, 27' under tension is precisely aligned with an area on an object where a line is to be marked, the bubble in the spirit tube which may be for horizontal or vertical marking depending upon whether the object is orientated horizontally or vertically whereby the position of the string section extending between the guide wheels 27, 27' coincides with the indication given by the spirit level 24.

The angle members 25, 25 secured to the stop rings 15, 15' at the opposite ends of the main pipe 11 are so designed that when the line marking device is employed for marking a line on an object orientated vertically, the line marking device is orientated vertically and one of the angle members 25, 25 (for example, the left-hand angle member as seen in FIG. 1) has one end of a line marking string 28' secured thereto to allow the string to suspend vertically by the gravity of the weight 28'' at the other end of the string.

Figure 3:
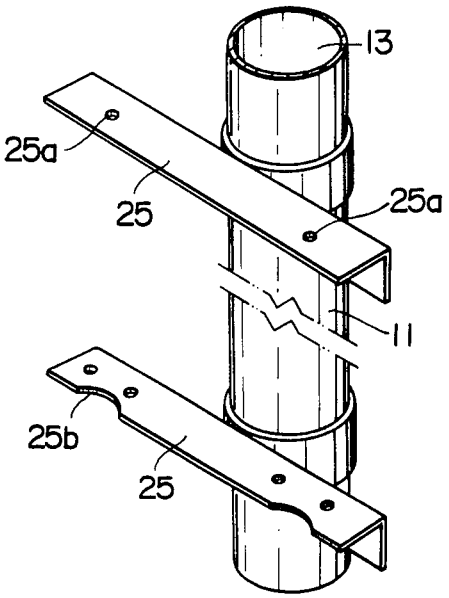
FIG. 3 is a fragmentary vertically perspective view on an enlarged scale showing the angle members of said line marking device.

As more clearly shown in FIG. 3, one of the angle members 25, 25 (the upper angle member when the line marking device is employed in its vertically orientated position) is formed with a plurality of spaced through holes 25*a* through which the weighted string 28' passes selectively and similarly, the other or lower angle member in this case is provided with a plurality of spaced notches 25*b*, 25*b* in alignment with the through holes 25*a*, 25*a* in the first-mentioned angle member for accommodating the weight 28'' on the string 28'.

By the incorporation of the conventional suspension system into the line marking device of the invention, the line marking device is versatile, that is, the line marking device can be employed for marking lines on vertically orientated objects as well as those orientated horizontally.

The above-mentioned angle members 25, 25 also serve as positioning means by causing the angle member to abut against a building wall with the line marking device of the invention lying along the wall or to contact a building floor with the line marking device placed flat on the floor.

In operation, when the line marking device of the invention is operated for marking a line on an inner building wall, first of all, a vertical line as the reference line is set on the wall by the use of the suspension string 28' and the weight 28'', the opposite expansion joints 12, 12' (the upper and lower expansion joints in this application) are extended so as to extend the pipe assembly to a length corresponding to the distance between the building ceiling and floor, the arm members 19, 19' (the upper and lower arm members in this application) are caused to abut against the ceiling and floor of the building and to align the string 28' with the previously set vertical reference line. Thereafter, the adjusting screw 39 is loosened to allow the spirit level 24 to be adjusted to a proper orientation in which the bubble in the spirit tube for vertical line in the level is positioned in the center of the spirit tube whereby initial adjusting procedure is completed. By the initial adjustment, the line marking device is in a position to suspend the weighted string 28' vertically as indicated by the spirit level.

With the line marking device orientated as mentioned hereinabove, when a line is to be marked on the wall in the predetermined position, the main pipe 11 is leaned against the wall in the vicinity of the reference vertical line, the upper and lower arm members 19, 19' are caused to abut against the ceiling and floor, respectively, the main pipe 11 is erected upright by the use of the spirit level 24 and the set screws 16, 16' are tightened to set the extended length of the pipe assembly. Thereafter, the upper and lower arm members 19, 19' are pivoted towards the wall to draw the string 28' towards the wall.

When the retainer means associated with the reel 22 is released to set the reel free and the reel 21 is rotated to wind the string 28 about the reel 21, the string is passed through the ink pad assembly 30 to be inked within the inking chamber 33 and the rotation of the reels 21, 22 is terminated to tense the string 18 between the guide wheels 27, 27' whereby the string 18 is ready to mark a line on an object. In the line marking device according to the present invention, the string 18 is initially wound about the reel 22 and as the device continues to operate, the string 18 is payed out of the reel 23 and wound about the reel 21 until the reel 22 is deprived of the string 18 whereupon the rotation direction of the reels 21, 22 is reversed and the string 18 is then payed out of the reel 21 and rewound about the reel 22. When the reels 21, 22 are the conventional fishing reels with stoppers, the operation performance of the line marking device is improved.

As mentioned hereinabove, once the vertical suspension condition is set, successive vertical lines can be marked on an object orientated vertically by merely confirming the vertical suspension condition of the string from time to time.

And also when the line marking device is operated for marking a line on an object orientated horizontally, the same procedure may be repeated except that the spirit tube for horizontal line marking is employed in this case.

By the use of the line marking device of the invention, only one operator can mark both horizontal and vertical lines efficiently and precisely.

Furthermore, the line marking device of the invention can be satisfactorily operated on working sites of different heights and widths by varying the length of the pipe assembly with the use of the expansion joints. Even when the line marking device is operated for marking a line on an object in a high position, a footstool is not required to be used and the operator can operate standing on the floor Furthermore, in addition to line marking on building walls and floors, the device of the present invention can be also used for horizontal and vertical measurement outdoors. In such a case, only one operator can easily and positively perform the centering operation which would require a plural persons for the conventional devices whereby saving in personal expense and shortening in operation period.

While only one specific embodiment of the invention has been shown and described in detail, it will be understood that the same is for illustration purpose only and not to be taken as a definition of the invention, reference being had for this purpose to the appended claims.

What is claimed is:

1. A line marking device comprising:

an extensible pipe assembly;

first and second arm members pivoted to the opposite ends of said pipe assembly;

an ink pad assembly mounted on one of said first and second arm members;

first and second guide wheels rotatably mounted at the opposite ends of said first arm member;

first and second guide wheels rotatably mounted at the opposite ends of said second arm member;

first and second reels rotatably mounted on said pipe assembly in spaced positions along the length of the pipe assembly;

a line marking string anchored at the opposite ends to said first and second reels and guided along a path defined by said guide wheels;

said first and second guide wheels being adapted to alternately pay out thereof and wind thereabout said line marking string;

a spirit level mounted on said pipe assembly between one end of the pipe assembly and one of said first and second reels;

angle members secured to the opposite ends of said pipe assembly; and a weighted line marking string having one end anchored to one of said angle members and the other end carrying a weight thereon.

2. The line marking device as set forth in claim 1, in which said extensible pipe assembly comprises a main pipe and first and second expansion joints telescopically received at first ends in the opposite end portions of said main pipe and having second ends to which said first and second arm members are pivoted.

3. The line marking device as set forth in claim 2, in which each of said first and second expansion joints comprises a first pipe section telescopically received in the adjacent end portion of the main pipe and a second pipe section telescopically received at one end thereof in the adjacent end portion of said first pipe section and having the other end to which one of said arm members is pivoted.

4. The line marking device as set forth in claim 2, further including stop rings mounted on the opposite ends of said main pipe, set screws on said stop rings, stop rings mounted on said first pipe sections of the expansion joints and set screws on said stop rings on the first pipe sections.

5. The line marking device as set forth in claim 1, in which said ink pad assembly comprises a bottom support member, an inking chamber supported on said bottom support member and containing an ink pad therein, said inking chamber having hole means through which said line marking string passes, an ink tank supported on said inking chamber in fluid communication with the chamber and an air flow regulation plug threaded in said ink tank.

* * * * *